US005119802A

United States Patent [19]

Cherry et al.

[11] Patent Number: 5,119,802

[45] Date of Patent: Jun. 9, 1992

[54] GAS COOKTOP APPLIANCE FOR USE WITH DOWNDRAFT VENTILATION SYSTEM

[76] Inventors: David N. Cherry, 14102 Shelbyville Rd., Louisville, Ky. 40245; David L. Kinny, 3200 Furman Blvd., Louisville, Ky. 40220; Gerald J. Kushner, 10206 Broad Run Rd., Louisville, Ky. 40299

[21] Appl. No.: 756,549

[22] Filed: Sep. 9, 1991

[51] Int. Cl.[5] ..... F24C 3/00

[52] U.S. Cl. ..... 126/39 E; 126/21 A; 126/299 D; 431/264

[58] Field of Search ..... 126/39 R, 39 E, 41 R, 126/299 R, 299 D, 21 R, 21 A, 39 K, 42, 214 R, 214 D, 39 BA, 300, 301; 431/258, 263-266

[56] References Cited

U.S. PATENT DOCUMENTS 4,020,821 5/1977 Reid, Jr. et al. ..... 126/39 E
4,413,611 11/1983 Berlik et al. ..... 126/39 E
4,750,470 6/1988 Beach et al. ..... 126/299 D
4,781,170 11/1988 Perl ..... 126/39 E
5,000,157 3/1991 Harper, Jr. et al. ..... 126/41 R

*Primary Examiner*—James C. Yeung

[57] ABSTRACT

An improved gas fueled cooking appliance incorporating surface heating units comprising burners with automatic reignition capability adapted for use in combination with surface level downdraft venting is provided with an air deflector disposed proximate the igniter to alter the flow of air in the vicinity of the igniter so as to prevent the downdraft vent induced air flow from moving the flame from the igniter. In a preferred form the air deflector is a thin wall extending upwardly from the cooktop surface. The wall extends away from the burner with the end of the wall nearest the burner being laterally spaced from and even with or downstream from the igniter electrode located on the periphery of the burner.

20 Claims, 3 Drawing Sheets

FIG. 6
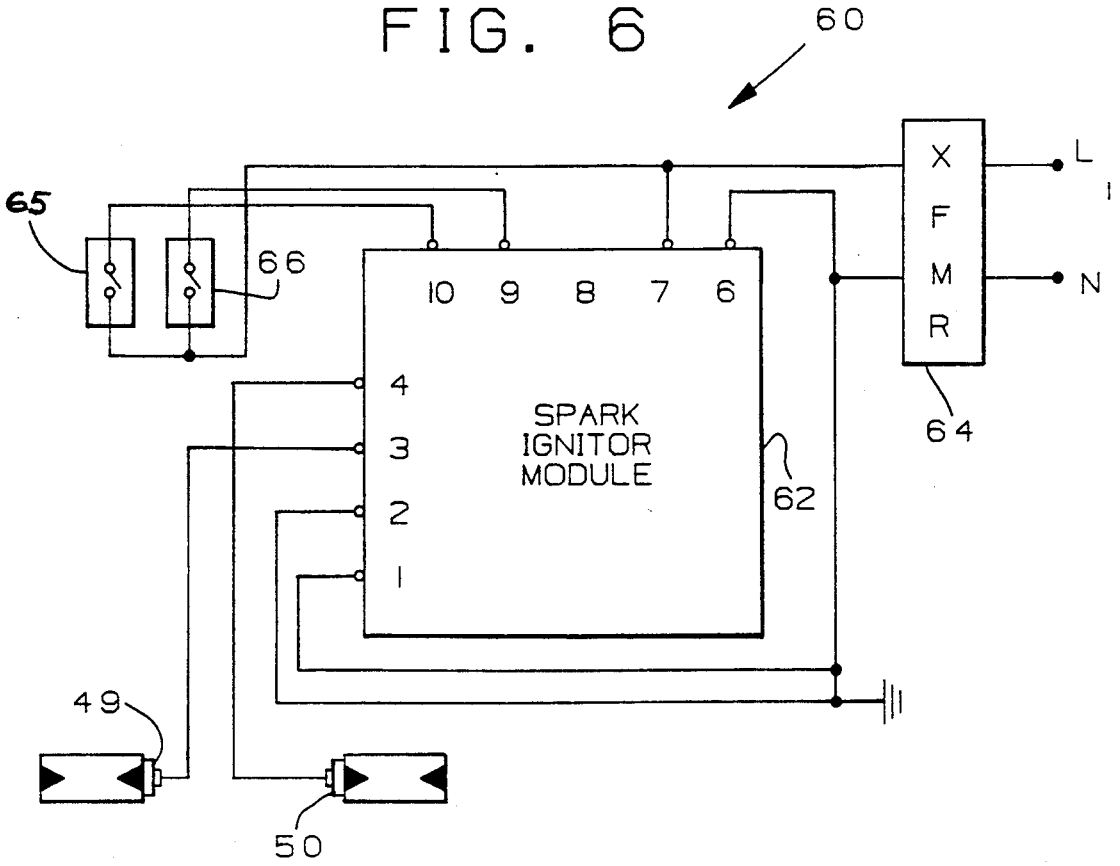
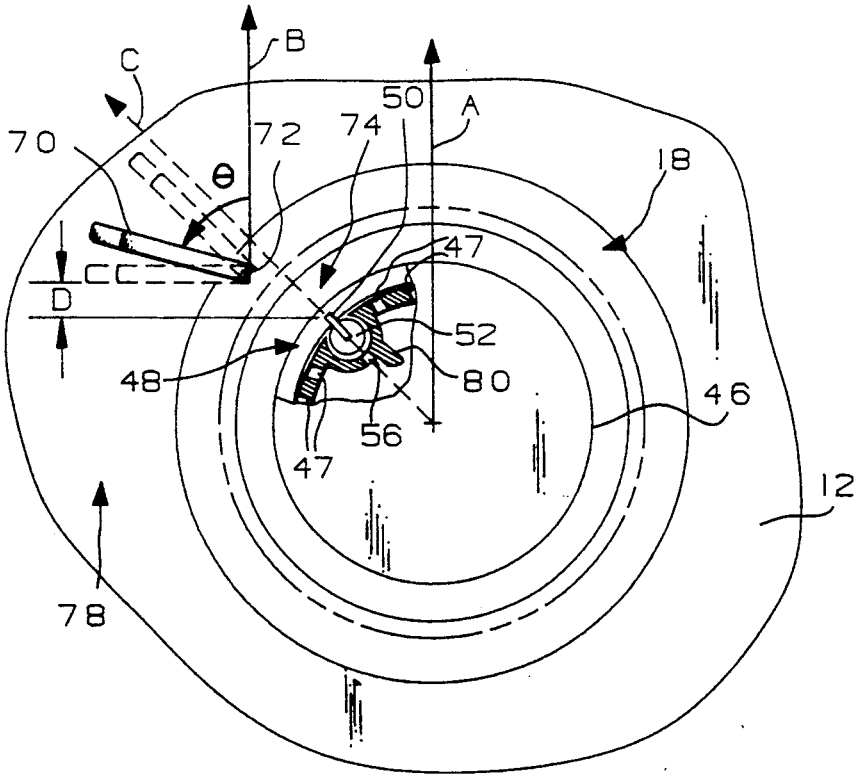
FIG. 7

GAS COOKTOP APPLIANCE FOR USE WITH DOWNDRAFT VENTILATION SYSTEM

CROSS-REFERENCE TO RELATED APPLICATIONS

This application relates to commonly assigned copending design application entitled Modular Gas Cooktop by Falk filed on the same date as this application.

BACKGROUND OF THE INVENTION

This invention relates to gas fueled cooking appliances and more specifically to appliances with gas fueled surface heating units to be used in combination with a downdraft vent system.

Conventional downdraft venting system configurations with an exhaust air inlet located at cooktop level for removing combustion products and cooking vapors from the cooktop area work well with electric surface units. However, when used in combination with gas fueled surface units, the downdraft induced air flow at the cooktop surface tends to interfere with the gas flame. Examples of gas fueled appliances combining surface level downdraft venting with gas fueled surface units can be found in U.S. Pat. No. 4,413,610 to Berlik and U.S. Pat. No. 4,750,470 to Beach et al.

Beach et al describes a grill burner arrangement in which the grill burners are configured to provide greater heat output adjacent a side wall of the burner pan which is substantially opposite the air inlet of the downdraft ventilation system to compensate for the effects of the downdraft induced air flow on the performance of the grill burners. However, neither patent addresses surface heating unit problems caused by the downdraft induced surface level air flow.

In each of these examples, the surface heating units comprise standard gas burners which draw secondary air for the burners from the area beneath the cooking surface through an annular opening at the base of each burner. Spark ignition is provided by an ignition system disposed beneath the cooktop surface, using an igniter located relatively remotely from the burner ports and operatively coupled to the burners by flashtubes. In such arrangements the ignition system is relatively unaffected by the downdraft induced airflow in the vicinity of the burner. However, no provision is made in either example for automatic re-ignition of the burners.

Spark ignition systems are known in the art which do provide automatic re-ignition by detecting the absence of flame at the burner and respond by generating a spark to ignite the burner when the gas is initially turned on, and also to automatically re-ignite the burner in the event the flame goes out while the burner remains turned on. Examples of such automatic spark ignition systems can be found in U.S. Pat. Nos. 4,626,196 and 4,810,188. In such systems, the spark electrode also serves as a flame sensor. The circuitry is arranged such that when the burner is turned on, the ignition system generates a spark whenever flame is absent from the vicinity of the spark gap. It may be desirable to locate the electrode at the periphery of the burner proximate a burner port and hence exposed to the downdraft induced air flow.

Such ignition systems work well when used with surface burners which are not used in combination with surface level downdraft vent systems. However, use of such ignition systems for burners used in combination with a downdraft ventilation system in which the air inlet is located at burner level, the air flow in the vicinity of the burners induced by the downdraft vent system, tends to pull the flame away from the igniter electrode, causing the igniter system to generate a spark unnecessarily. This can result in repetitive "nuisance sparking" when one or more surface burners are on simultaneously with the downdraft vent system blower. Though such sparking does not present a safety hazard or otherwise interfere with the operation of the heating units, it does cause an annoying popping noise.

It is therefore a primary object of the present invention to provide an improved gas fueled cooking appliance which includes surface heating units with automatic spark ignition for use in combination with a surface level downdraft vent arrangement which substantially eliminates nuisance sparking caused by downdraft induced air flow in the vicinity of the surface burners.

SUMMARY OF THE INVENTION

The present invention provides an improved gas fueled cooking appliance incorporating surface heating units comprising burners with automatic re-ignition capability adapted for use in combination with surface level downdraft venting. In accordance with the invention, air deflector means is disposed proximate the igniter to alter the flow of air in the vicinity of the igniter so as to prevent the downdraft vent induced air flow from moving the flame from the igniter.

In a preferred form of the invention, the air deflector means comprises a thin wall extending upwardly from the cooktop surface. The wall extends away from the burner with the end of the wall nearest the burner being laterally spaced from and even with or downstream from the igniter electrode in the downdraft induced air flow path. The igniter electrode is located on the periphery of the burner at a point intersected by a radial line extending from the center of the burner at an angle on the order of 45 degrees measured counter-clockwise from a reference line extending from the center of the burner toward the air inlet in a direction generally parallel to the primary air flow path for air being drawn past the burner toward the air inlet. Satisfactory results were achieved with a configuration in which the wall extends away from the burner at an angle in the range of 45–90 degrees measured counter-clockwise from a reference line extending from the burner toward the downdraft air inlet in a direction generally parallel to the direction of the primary downdraft induced air flow in the vicinity of the burner. The optimum angle was found to be approximately 75 degrees.

In a typical configuration, the air inlet for the downdraft vent system is located adjacent to and extends along one side of at least one heating unit in a plane at substantially the same level as the cooktop surface. In such a configuration, the position of the wall can be defined as extending away from the burner at an angle in the range of 45–90 degrees, preferably approximately 75 degrees, measured counter-clockwise from a reference line extending from the burner toward the air inlet in a direction generally perpendicular to that portion of the edge of the air intake opening nearest the burner. The position of the igniter can be similarly defined as being located at a point on the periphery of the burner intersected by a radial line extending at an angle of approximately 45 degrees measured counter-clockwise from a reference radial line extending from the center of the burner toward the air inlet in a direction generally perpendicular to that portion of the edge of the air inlet opening nearest the burner.

BRIEF DESCRIPTION OF THE DRAWINGS

While the novel aspects of the invention are set forth with particularity in the appended claims, the invention both as to organization and content will be better understood and appreciated from the following detailed description taken in conjunction with the drawings in which:

FIG. 6 is a simplified schematic circuit diagram of the ignition circuit for the surface heating units for the cooktop of FIG. 1; and FIG. 7 is an enlarged top view of a portion of the cooktop of FIG. 1 including one of the burners and the air deflector constructed in accordance with the invention, with a portion of the burner cap removed to illustrate the spark electrode and with alternative positions of the air deflector shown in phantom lines.

DETAILED DESCRIPTION OF THE PREFERRED EMBODIMENTS

Figure 1:
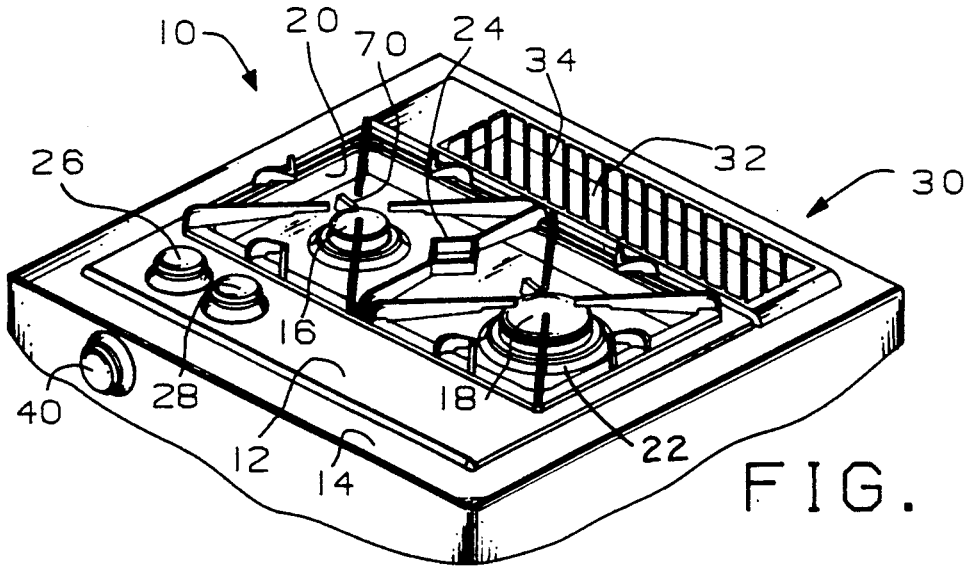
FIG. 1 is a perspective view of a gas fueled cooktop appliance illustratively embodying the present invention.
Figure 2:
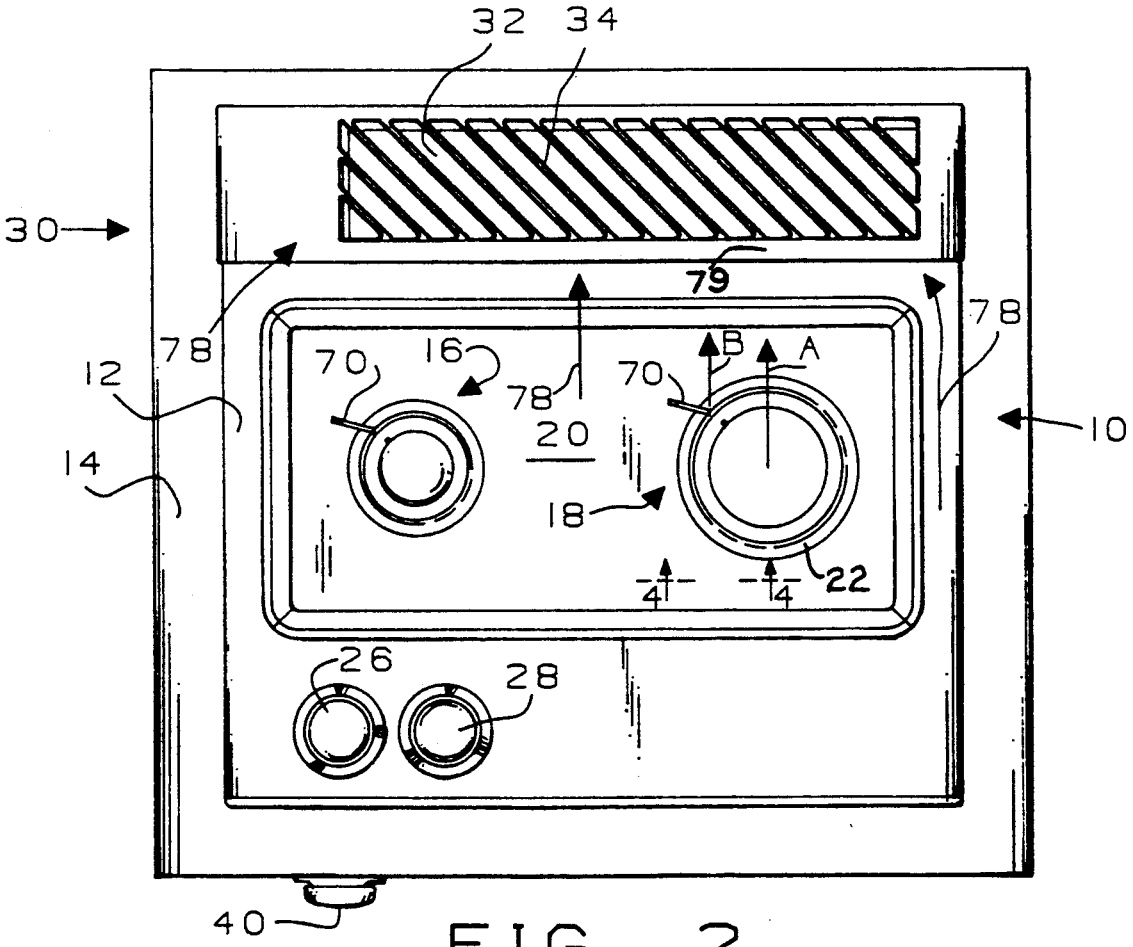
FIG. 2 is a top view of the cooktop of FIG. 1 with the burner grates removed.
Figure 3:
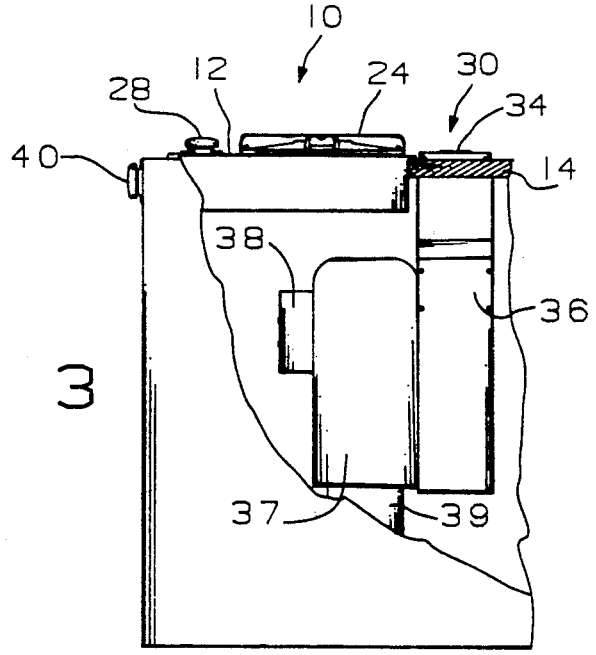
FIG. 3 is a side view of the cooktop of FIG. 1 with a portion of the cabinetry supporting the cooktop removed to illustrate the downdraft plenum.

Referring first primarily to FIGS. 1-3, there is shown a gas fueled cooking appliance in the form of a modular cooktop designated generally 10 comprising a cooktop surface 12 mounted from a supporting countertop 14. The cooktop 10 includes a pair of gas surface heating units 16 and 18 disposed in a generally rectangular depression 20 formed in the cooktop surface 12 to contain spills. Each of the heating units 16 and 18 sits in an opening in the cooktop surface 12 surrounded by annular shoulder 22. A removable grate 24 is provided to support cooking utensils over the heating units 16 and 18. Control knobs 26 and 28 for heating units 16 and 18 respectively enable the user to turn the units on and off and adjust the heat settings.

In the configuration of FIG. 1, a modular downdraft venting system designated generally 30 is installed in the countertop 14 adjacent to and extending along the rear edge of the cooktop 10. The air intake means for the downdraft system comprises a generally rectangular air inlet opening 32 covered by an air inlet grate 34. Grease laden air in the area above the cooktop 10 is drawn into air plenum 36 via the air inlet opening 32 by operation of blower 37 driven by blower motor 38. The blower 37 forces air from the plenum 36 to the atmosphere via an exhaust duct 39. The blower 37 has an air flow rating of 500 cubic feet per minute. Operation of the downdraft blower motor 38 is controlled by control knob 40.

In the illustrative embodiment herein described, the heating units 16 and 18 comprise so-called sealed gas burners, of the type commercially available from Sourdillon Airindex, SA, identified by the model numbers 51933 and 51932, respectively. The term "sealed burner" refers to the lack of an annular opening in the cooktop surface around the base of the burner which is characteristic of standard gas surface unit burners. Elimination of this opening prevents spills from entering the area beneath the range top, making cleanup easier. The surface unit 16 is rated at 6,000 BTU/hour and the surface unit 18 is rated at 10,500 BTU/hour. It will be appreciated that the details of the particular heating units herein described are provided for illustrative purposes and the size and number of heating units incorporated in the cooktop appliance are not intended to be nor should they be construed as limitations to the present invention.

Figure 4:
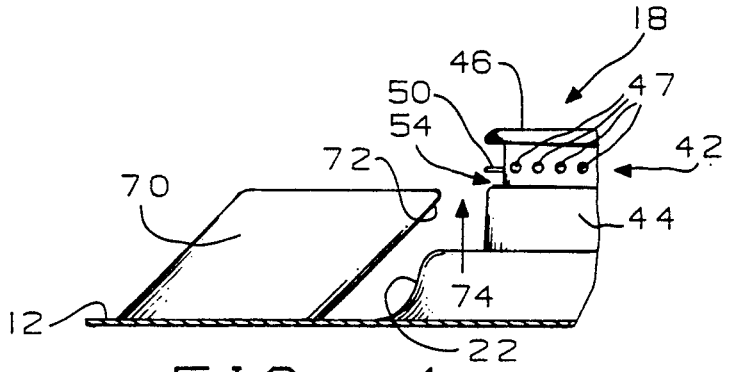
FIG. 4 is a enlarged fragmentary sectional view of a portion of the cooktop of FIG. 1 taken along lines 4—4.
Figure 5:
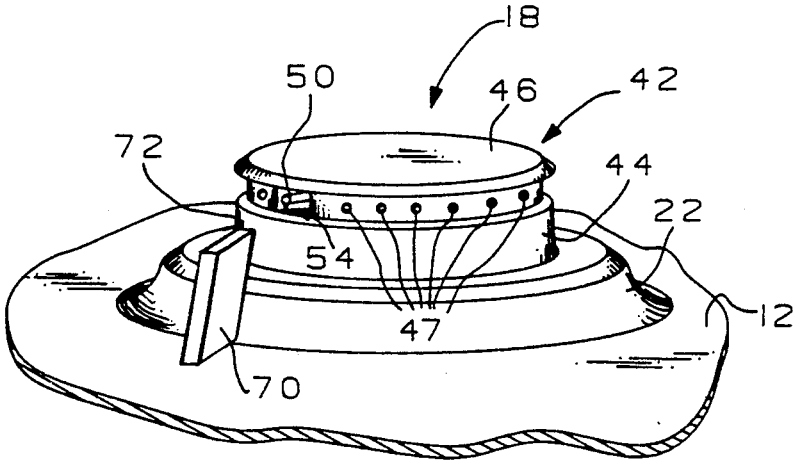
FIG. 5 is an enlarged perspective view of a portion of the cooktop of FIG. 1 including one of the burners.

The heating unit description to follow is directed to the heating unit 18. It will be appreciated however, that the structural configuration of the heating unit 16 is substantially the same except that heating unit 16 is somewhat smaller. As best seen in FIGS. 4 and 5, heating unit 18 includes a burner 42, comprising a base 44 and a removable cap 46. The cap 46 has a plurality of gas ports 47 generally uniformly spaced about its periphery. However in order to reduce flame impingement on the inwardly extending arms of the grate 24 which extend over the heating units, in the burner cap 46 three port locations are blank and one is of reduced diameter and recessed from the periphery to accomodate a spark igniter as will be hereinafter described in greater detail. The three blank port locations and the recessed port are equally spaced about the periphery of the burner cap 46. When fully assembled, the burner 42 is oriented such that the blank and recessed port locations are located directly beneath the inwardly extending arms of the grate 24.

The surface unit 18 also includes an igniter 48 mounted at the periphery of the burner base 44 for spark ignition. The igniter 48 comprises a wire electrode 50 partially encased in a ceramic insulating jacket 52 (FIG>7) with the free end of the electrode 50 projecting radially outwardly from the burner base 44 defining a spark gap 54 between the tip of the electrode 50 and the electrically grounded burner base 44 directly beneath the electrode 50. The igniter electrode 50 is connected in conventional fashion to a spark module 62 (FIG. 6) of the type commercially available from Harper Wyman Company identified by model number 6526, which generates a spark at gap 54 to ignite gas issuing out of the adjacent recessed gas port 56 formed in cap 46.

The ignition circuit 60 for generating the spark at the electrode 50 is illustrated schematically in FIG. 6. The standard 120 volt AC 60 Hz power supply lines L1 and N are coupled to the Harper Wyman spark igniter module 62 via isolation transformer 64. ON/OFF switches 65 and 66 for the heating units 16 and 18 respectively are mechanically opened and closed by the rotation of the control knobs 26 and 28 respectively in conventional manner by mechanical linkage not shown. The switches 65 and 66 are open when the corresponding control knobs are in the OFF position and closed otherwise. The igniters 49 and 50 for heating units 16 and 18 respectively, are electrically connected to pins 3 and 4 of spark module 62. The internal circuitry of the spark module 62 is operative to generate a spark across the gap 54 when no flame is detected at the gap 54.

Briefly, the spark module ignition system is based on the flame rectification phenomena, which refers to the flame plasma in the spark gap functioning as a diode. When the circuit is energized, an AC signal is applied to the spark gap. When a flame is present, the resistance across the gap for one polarity is greater than for the other. When no flame is present, the resistance is the same for both polarities. The circuitry is arranged to monitor the effective resistance across the spark gap and generate a spark when the sensed resistance indicates that no flame is present. By this arrangement, a spark is provided when the burner is initially turned on, and is also automatically reignited by a spark in the event a flame is not present at the electrode at any time while the burner remains turned on.

As discussed briefly in the Background section, when used for surface units configured in combination with a downdraft venting system, the air flow at the cooking surface proximate the burners tends to pull the flame away from the ignition electrode sufficiently to result in unnecessary "nuisance" sparking. Though a flame is actually present at the burner, the downdraft induced air flow creates a gap between the burner port proximate the igniter electrode and the base of the flame supported by gas from that port sufficient to deceive the flame detector circuitry, which responds by generating a spark. Though not harmful or dangerous, the popping noise associated with the spark is annoying. In accordance with the present invention, this problem is overcome by providing air deflector means proximate the igniter electrode which effectively alters the flow of downdraft induced air in the vicinity of the igniter to substantially prevent the air flow from moving the flame away from the igniter.

As best seen in FIGS. 4, 5 and 7, in the illustrative embodiment, air deflector means is provided for heating unit 18 in the form of a relatively thin wall member 70 which projects generally upwardly from the cooktop surface 12 with one end 72 of the wall member 70 laterally spaced from the igniter electrode 50 defining an air gap 74 therebetween. It was empirically determined that the higher and closer the wall member 70 is to the igniter electrode 50 the more effective it is in terms of reducing nuisance sparking. However, the height of the wall member 70 and its proximity to the igniter electrode 50 are constrained by the requirement to avoid flame impingement on the wall member 70.

In the illustrative embodiment the wall member 70 is formed of low carbon steel in the shape of a parallelogram having a base dimension of 1.0 inch, a height of 0.625 inches and a thickness of 0.125 inches and is welded to the flat area of the cooktop surface 12 proximate the annular shoulder 22. The angle of inclination of the parallelogram is approximately 45 degrees relative to the cooktop surface 12. The parallelogram shape is dictated primarily by the need to provide a sufficiently small lateral air gap between the igniter electrode 50 and the wall member 70 while at the same time attaching the base of the wall member 70 securely to the flat portion of the cooktop surface 12. While the air deflector means in the illustrative embodiment is a separately formed wall member, the deflector means could also be formed integrally with the cooktop surface.

Orientation of the wall member 70 and the igniter electrode 50 relative to the general direction of the downdraft induced air flow path in the vicinity of the burner 42 significantly impacts the effectiveness of the wall member 70 in preventing nuisance sparking. Referring now in particular to FIGS. 2 and 7, reference lines A and B extend generally parallel to the direction of the main air flow path for the downdraft induced air movement in the vicinity of burner 42 of heating unit 18. The airflow direction as indicated by the arrows 78 is toward the air inlet opening 32, in a direction which is substantially perpendicular to that portion of the edge of the air inlet opening 32 nearest the burner 42 of heating unit 18 designated 79 in FIG. 2.

Choice of location of the igniter electrode 50 along the periphery of the burner 42 of heating unit 18 was limited in part in the illustrative embodiment by the aforementioned need to avoid flame impingement on the arms of the grate 24 extending above the burner 42. Referring again briefly to FIG. 1, it can be seen that the inwardly extending arms of the grate 24 form an open centered X centered over each of heating units 16 and 18 rotated approximately 45 degrees relative the reference line A. The choice of igniter position was limited by the need to locate the igniter for each burner under one of the four arms of the grate extending over that burner. Of the four it was empirically determined that the best performance in terms of minimal interference of the downdraft induced air flow with burner and ignition system operation was achieved by orienting the burner 42 such that the igniter electrode 50 is located at a point on the periphery of the burner 42 intersected by a radial line C extending from the center of the burner 42 at an angle of approximately 45 degrees measured counterclockwise from reference line A. A locating tab 80 (FIG. 7) projects from the inner wall of the burner cap 46 proximate the recessed burner port 56. A corresponding slot (not shown) is formed in the burner base 44 to receive the tab 80 when the removable burner cap 46 is properly aligned. While as above mentioned, this position was found to provide the best performance, it will be appreciated, that other locations could be utilized for the igniter location consistent with the present invention.

Referring next to the positioning of the air deflector means, the wall member 70 is spaced radially from the electrode 50 defining a gap at 74 of approximately 0.35 inches. It was observed that better results are obtained if the upstream end of the wall member 70 is located even with or downstream from the electrode 50 in the downdraft airflow path. In the illustrative embodiment the upstream edge of the wall member 70 located nearest to igniter 50 is spaced downstream from the electrode 50 by a distance represented in FIG. 7 as D, which in the illustrative embodiment is approximately 0.2 inches. The wall member 70 extends away from the burner 42 at an angle represented in FIG. 7 by O. Optimum performance of the wall member 70 in reducing nuisance sparking was achieved with a configuration in which O is approximately 75 degrees measured counterclockwise from reference line B. Acceptable performance of the wall member 70 in reducing nuisance sparking was found to be achievable for values of O in the range of 45–90 degrees, with the extremes represented in phantom in FIG. 6. It was found that orientation of the wall outside of this range tended to substantially degrade its effectiveness.

While in accordance with the Patent Statutes, a specific embodiment of the present invention has been illustrated and described herein, it is realized that numerous modifications and changes will occur to those skilled in the art. For example the specific wall orientation for optimum performance may vary depending on the orientation of the igniter and other structural factors unique to particular cooktop and burner designs. Such parameters are best determined empirically for each particular cooktop, burner and downdraft vent configuration. It is therefore to be understood that the appended claims are intended to cover all such modifications and changes as fall within the true spirit and scope of the invention.

What is claimed is:

1. A gas fueled cooking appliance comprising:

a cooktop surface;

at least one surface heating unit mounted in an opening in the cooktop surface, comprising a gas fueled burner and automatic spark igniter means;

downdraft vent means including air intake means disposed adjacent to said heating unit at a level not substantially higher than said heating unit; and air deflector means disposed proximate said igniter means to alter the flow of air in the vicinity of said igniter means induced by said downdraft vent means to prevent the downdraft vent induced air flow from pulling the flame from said igniter means whereby nuisance sparking by said igniter means is substantially reduced.

2. A gas fueled cooking appliance in accordance with claim 1 wherein said igniter means includes an electrode disposed at the periphery of said burner having a free end projecting therefrom, and said air deflector means comprises wall means extending upwardly from the cooktop surface proximate said burner with one end laterally spaced from said electrode defining an air gap therebetween, and the opposite end remote therefrom.

3. A gas fueled cooking appliance in accordance with claim 2 wherein said wall means extends away from said burner at an angle in the range of 45–90 degrees measured counter-clockwise from a reference line extending from said burner toward said air intake means in a direction generally parallel to the direction of the primary downdraft induced air flow in the vicinity of said burner.

4. A gas fueled cooking appliance in accordance with claim 3 wherein said angle is approximately 75 degrees.

5. A gas fueled cooking appliance in accordance with claim 3 wherein said igniter electrode is positioned on the periphery of said burner at a point intersected by a radial line extending from the center of the burner at an angle of approximately 45 degrees measured counter-clockwise from said reference line extending generally parallel to the general direction of the primary downdraft induced air flow in the vicinity of the burner.

6. A gas fueled cooking appliance in accordance with claim 5 wherein said one end of said wall means is positioned in the downdraft air flow path even with or downstream from said igniter electrode.

7. A gas fueled cooking appliance in accordance with claim 6 wherein said wall means extends at an angle of approximately 75 degrees.

8. A cooking appliance of the type having a cooktop surface for surface cooking and intended for use in combination with a downdraft vent system of the type having an air intake opening disposed closely adjacent to and not substantially higher than the cooktop surface, said appliance comprising:

at least one gas fueled surface heating unit mounted in an opening in the cooktop surface and comprising a burner and automatic spark igniter means including an igniter electrode disposed at the periphery of said burner with a free end projecting therefrom; and air deflector means disposed proximate said igniter electrode to alter the flow of air in the vicinity of said igniter electrode induced by the downdraft vent system to prevent the downdraft induced air flow from pulling the flame from said igniter electrode whereby nuisance sparking by said igniter means is substantially reduced.

9. A cooking appliance in accordance with claim 8 wherein said air deflector means comprises wall means projecting vertically from the cooktop surface proximate said burner with one end of said wall means laterally spaced from said electrode defining an air gap therebetween, and the other end remote therefrom.

10. A cooking appliance in accordance with claim 9 wherein said wall means extends away from said burner at an angle in the range of 45–90 degrees measured counter-clockwise from a reference line extending substantially parallel to the direction of the primary downdraft induced air flow in the vicinity of said burner.

11. A cooking appliance in accordance with claim 10 wherein said angle is approximately 75 degrees.

12. A cooking appliance in accordance with claim 10 wherein said igniter electrode is positioned on the periphery of said burner at a point intersected by a radial line extending from the center of the burner at an angle of approximately 45 degrees measured counterclockwise from said reference line extending generally parallel to the general direction of the primary downdraft induced air flow in the vicinity of said burner.

13. A cooking appliance in accordance with claim 12 wherein said wall means extends at an angle of approximately 75 degrees.

14. In a cooking appliance of the type having at least one gas fueled surface heating unit comprising a burner and automatic spark igniter means including a spark electrode disposed at the periphery of the burner with a free end projecting therefrom, which unit is mounted in a cooktop surface for surface cooking and intended for use in combination with a downdraft venting system of the type having an air intake opening located adjacent to and extending along one side of the burner and disposed not substantially higher than the heating unit, the improvement wherein air deflector means is disposed proximate the igniter electrode to alter the flow of air in the vicinity of the electrode induced by the downdraft venting system to prevent the downdraft induced air flow from pulling the flame from the igniter electrode whereby nuisance sparking by the igniter means is substantially reduced.

15. The improvement of claim 14 wherein said air deflector means comprises wall means extending upwardly from the cooktop surface proximate the burner, said wall means having one end laterally spaced from the igniter electrode defining a gap therebetween with the opposite end remote therefrom.

16. The improvement of claim 15 wherein said wall means extends away from the burner at an angle in the range of 45–90 degrees measured counter-clockwise from a reference line extending generally perpendicular to the edge of the air intake opening proximate the burner.

17. The improvement of claim 16 wherein said angle is approximately 75 degrees.

18. The improvement of claim 16 wherein the igniter electrode is positioned on the periphery of the burner at a point intersected by a radial line extending from the center of the burner at an angle on the order of 45 degrees measured counter-clockwise from said reference line extending generally perpendicular to the edge of the air intake opening proximate the burner.

19. The improvement of claim 18 wherein said one end of said wall means is located in the downdraft induced air flow path even with or downstream from said igniter electrode.

20. The improvement of claim 19 wherein said wall means extends at an angle of approximately 75 degrees.

* * * * *